US008341863B2

(12) United States Patent
Kefer

(10) Patent No.: US 8,341,863 B2
(45) Date of Patent: Jan. 1, 2013

(54) BARREL HOLDER FOR A DROP-DOWN BARREL WEAPON

(75) Inventor: Hubert Kefer, Bad Ischl (AT)

(73) Assignee: Steyr Mannlicher Holding GmbH, Kleinraming (AT)

( * ) Notice: Subject to any disclaimer, the term of this patent is extended or adjusted under 35 U.S.C. 154(b) by 153 days.

(21) Appl. No.: 12/522,328

(22) PCT Filed: Jan. 18, 2007

(86) PCT No.: PCT/AT2007/000017

§ 371 (c)(1),
(2), (4) Date: Jul. 7, 2009

(87) PCT Pub. No.: WO2008/086546

PCT Pub. Date: Jul. 24, 2008

(65) Prior Publication Data

US 2010/0031550 A1 Feb. 11, 2010

(51) Int. Cl.
*F41A 15/00* (2006.01)

(52) U.S. Cl. ..... 42/46; 42/40; 42/47; 42/77

(58) Field of Classification Search ..... 42/46, 47, 42/40, 75.04, 75.02, 75.01, 76.01, 77
See application file for complete search history.

(56) References Cited

U.S. PATENT DOCUMENTS

| | | | | |
|---|---|---|---|---|
| 3,142,125 | A | 7/1964 | Groover | |
| 3,339,304 | A * | 9/1967 | Knode, Jr. et al. | 42/77 |
| 3,845,581 | A * | 11/1974 | Infantino | 42/76.01 |
| 3,984,933 | A * | 10/1976 | Ruger | 42/47 |
| 5,018,293 | A | 5/1991 | Mainland | |
| 5,095,643 | A * | 3/1992 | Fisher | 42/44 |
| 6,907,687 | B2 * | 6/2005 | Rousseau et al. | 42/75.02 |

FOREIGN PATENT DOCUMENTS

| | | |
|---|---|---|
| DE | 3839776 A1 | 6/1990 |
| EP | 0862038 A2 | 1/1998 |
| GB | 2136935 A | 9/1984 |

* cited by examiner

*Primary Examiner* — Gabriel Klein
(74) *Attorney, Agent, or Firm* — Hoffmann & Baron, LLP

(57) ABSTRACT

A barrel holder for a drop-down barrel weapon with at least one tapped hole for accommodating an interchangeable barrel which ends in a ring shoulder for supporting the edge of a cartridge, wherein a first circumferential section of the ring shoulder is constructed as an axially movable cartridge extractor, and the remaining second circumferential section of the ring shoulder is formed by a separate adapter part which is inserted in modular fashion into the barrel holder.

5 Claims, 1 Drawing Sheet

BARREL HOLDER FOR A DROP-DOWN BARREL WEAPON

This application is the U.S. National Phase of International Application No. PCT/AT2007/000017 filed on Jan. 18, 2007, the disclosure of which is incorporated herein by reference.

BACKGROUND OF THE INVENTION

The present invention relates to a barrel holder for a drop-down barrel weapon with at least one tapped hole for accommodating an interchangeable barrel, which opens into a ring shoulder for supporting the edge of a cartridge, wherein one circumferential section of the ring shoulder is configured as an axially movable cartridge extractor.

A barrel holder of this type is described in patent EP 0 862 038, for example. The known barrel holder only allows the use of interchangeable barrels of exactly the same calibre, otherwise a step remains between the barrel interior and the ring shoulder that can lead to an unchecked deformation (floating) of the cartridge during firing, which is an extremely dangerous situation.

SUMMARY OF THE INVENTION

The aim set by the invention is to provide a barrel holder for a drop-down barrel weapon that allows the use of interchangeable barrels of different calibres with a high safety standard. This aim is achieved with a barrel holder of the aforementioned type that is distinguished according to the invention in that the remaining circumferential section of the ring shoulder is formed by a separate adapter part, which is inserted in modular fashion into the barrel holder.

Thus, in association with a corresponding replacement of the cartridge extractor, a modular barrel holder system is provided that is perfectly adaptable to interchangeable barrels of different calibres. All that is required for this is to replace the cartridge extractor and the adapter part in keeping with the calibre of the barrel used and the form of cartridge case. Any free spaces in the cartridge storage area, in particular in the area supporting the cartridge edge, that could lead to an unchecked and dangerous floating of the cartridge are prevented as a result of this.

According to a preferred embodiment of the invention, the adapter part has a first axial section, the inside diameter of which is the same as the inside diameter of the interchangeable barrel to be accommodated, and a second axial section, the inside diameter of which is the same as the outside diameter of the cartridge edge to be accommodated. The adapter part can thus be combined with cartridge extractors of conventional design to form a ring shoulder that is adapted exactly to the cartridge to be accommodated and does not leave any free spaces.

It is particularly preferred if according to a further feature of the invention the adapter part can be secured by screwing in an interchangeable barrel between this and a shoulder of the barrel holder. As a result, the assembly and replacement of the adapter part is particularly simple, since this only needs to be inserted before the interchangeable barrel is screwed into the barrel holder.

BRIEF DESCRIPTION OF THE DRAWINGS

The invention shall be explained in more detail below on the basis of an exemplary embodiment shown in the attached drawings.

DETAILED DESCRIPTION OF THE INVENTION

Figure 1:
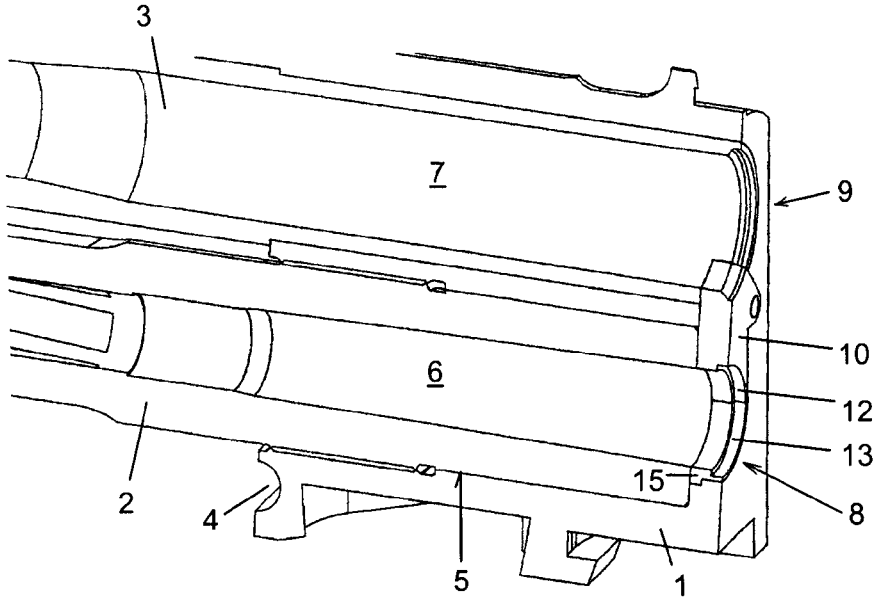
FIG. 1 is a sectional perspective view of the barrel holder of the invention with the cartridge extractor retracted.
Figure 2:
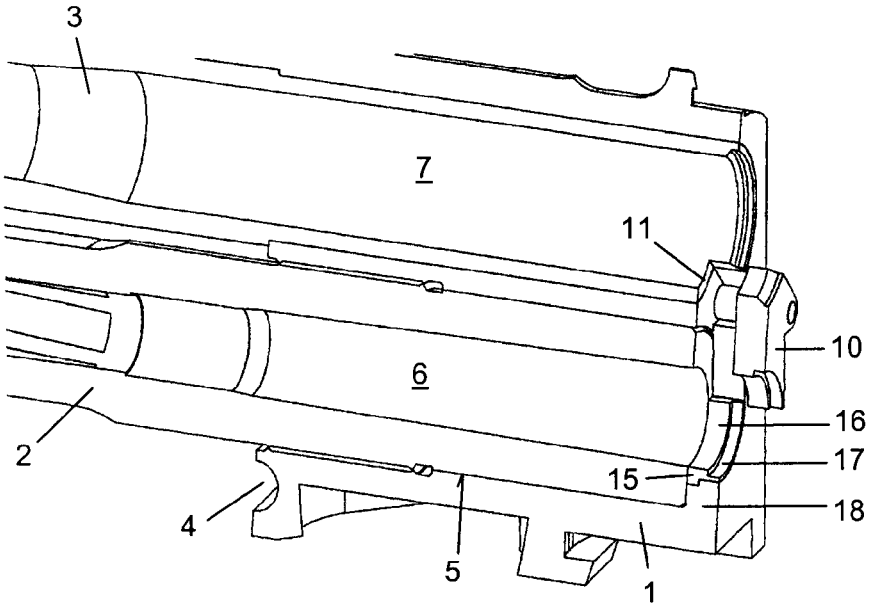
FIG. 2 shows the barrel holder in the same view with the cartridge extractor extended.

A barrel holder 1 ("mount") for a drop-down ("tip-up") barrel weapon (not shown) with two barrels 2, 3 is shown in half section in FIGS. 1 and 2 (second half symmetrical). In the present example the drop-down barrel weapon is an over/under shotgun-rifle with a rifled barrel 2 and a shotgun barrel 3 located above it. The barrel holder 1 is mounted at 4 to pivot in the link of a block lock (not shown), as is known in the art.

The upper barrel 3 is firmly anchored, e.g. pressed or welded, in the barrel holder 1. The lower barrel 2 is replaceably mounted in the barrel holder 1 as interchangeable barrel, i.e. is screwed into a tapped hole 5 of the barrel holder 1.

Each barrel 2, 3 has a cartridge storage area 6, 7 with a ring shoulder 8, 9 to support the edge of a inserted cartridge (not shown), as is known in the art. A respective circumferential section of each ring shoulder 8, 9 is formed by a common cartridge extractor 10 located between the barrels 2, 3.

The cartridge extractor 10 is guided in the barrel holder 1 parallel to the barrel axis between a retracted position (FIG. 1) and an extended position (FIG. 2). As part of the ring shoulder 8, 9 the cartridge extractor 10 respectively engages behind the edge of a cartridge inserted into the cartridge storage area 6, 7 and pushes this back slightly in the extended position (FIG. 2), so that it can be grasped by hand for removal.

The fixedly mounted barrel 3 is provided with a corresponding cut-out 11 to accommodate the cartridge extractor 10. In the case of the interchangeable barrel 2, such a cut-out would require the tapped hole 5 to be fabricated "in position"; in order to prevent this, the ring shoulder 8—unlike the ring shoulder 9 of barrel 3—is not configured on the barrel, but is configured separately on the barrel holder 1. The tapped hole 5 opens into the ring shoulder 8 of the barrel holder 1 and the interchangeable barrel 2 is screwed in until it rests against the ring shoulder 8.

As explained, the cartridge extractor 10 forms a first circumferential section 12 of the ring shoulder 8. The remaining second circumferential section 13 of the ring shoulder 8 is formed by a separate adapter part 15. The adapter part 15 is replaceably inserted into the barrel holder 1 in modular fashion and—together with the cartridge extractor 10—can be adapted to interchangeable barrels 2 of different calibres.

The adapter part 15 has a first axial section 16 with an inside diameter equal to the inside diameter of the cartridge storage area 6 and a second axial section 17 with an inside diameter equal to the outside diameter of the edge of a cartridge to be accommodated. The cartridge extractor 10 and the adapter part 15 thus combine to form the ring shoulder 8 without any free spaces remaining around the received cartridge that could lead to a dangerous floating of the cartridge during firing.

The adapter part 15 can be replaceably anchored in the barrel holder 1 in any type known in the art. It is preferably secured by screwing in the interchangeable barrel 2 between this and a shoulder 18 of the barrel holder 1.

It is understood that the barrel holder 1 can be designed for any desired types, arrangements and numbers of barrels 2, 3 so long as at least one interchangeable barrel is included therein. For example, the position of shotgun and rifle barrel can be interchanged, the barrels can be positioned next to one another instead of one above the other, three barrels ("three-barrelled gun") or also only one barrel etc. can be provided.

The invention is not restricted to the illustrated embodiments, but covers all variants and modifications that fall within the framework of the attached claims.

What is claimed is:

1. Barrel holder for a drop-down barrel weapon comprising:

at least one tapped hole, an interchangeable barrel including a corresponding thread to screw into the tapped hole, the barrel holder further including a ring shoulder receiving space between the tapped hole and a cartridge insertion end of the barrel holder for receiving a ring shoulder adapted to support an edge of a cartridge, and a circumferential ring shoulder positioned in the ring shoulder receiving space;

wherein the circumferential ring shoulder comprises a first arc section and a second arc section, the first arc section being formed from an interchangeable, axially movable cartridge extractor positioned in a retracted position, the axially movable cartridge extractor being movable between the retracted position and an extended position, the circumferential ring shoulder corresponding to the caliber of the interchangeable barrel, and the second arc section of the ring shoulder being formed by an interchangeable adapter part corresponding to the caliber of the interchangeable barrel, the interchangeable adapter part being sandwiched between the interchangeable barrel and a shoulder formed in the cartridge insertion end of the barrel holder, wherein the interchangeable adapter part comprises an inner curved surface shaped and sized to abut a portion of an outermost diameter of an edge of a cartridge to be accommodated in the interchangeable barrel, the adapter part being a separate removable and replaceable component part from the interchangeable barrel, and wherein the axially movable cartridge extractor has an inner curved surface having the same radius of curvature as the inner curved surface of the adapter part and sized to abut a remaining portion of an outermost diameter of an edge of a cartridge to be accommodated in the interchangeable barrel.

2. Barrel holder according to claim 1, wherein the adapter part further includes an axial section, the inside curvature of which corresponds to the inside diameter of the interchangeable barrel to be accommodated.

3. A weapon comprising:

a barrel holder having at least one tapped hole for receiving an interchangeable barrel and a ring shoulder receiving space for receiving a ring shoulder adapted to support an edge of a cartridge, the ring shoulder receiving space being positioned between the tapped hole and a cartridge receiving end of the barrel holder, the ring shoulder receiving space of the barrel holder including a tiered groove, the barrel holder further comprising a circumferential ring shoulder positioned in the receiving space and adapted to support an edge of a cartridge corresponding to the caliber of the interchangeable barrel, wherein the ring shoulder comprises an interchangeable adapter part inserted into the ring shoulder receiving space of the barrel holder and forming less than a circumferential whole of the ring shoulder, the adapter part being a component separate from the interchangeable barrel and forming a first arc section of the circumferential ring shoulder, the adapter part having an inner curved surface shaped and sized to abut a portion of an outermost diameter of an edge of a cartridge to be accommodated in the barrel, the remainder of the ring shoulder being formed by an interchangeable cartridge extractor positioned in a retracted position, wherein the cartridge extractor is configured to be moved axially with respect to the barrel holder between the retracted position and an extended position, and further wherein the adapter part includes a shoulder fitted into the tiered groove of the barrel holder and is secured in place by being sandwiched between the interchangeable barrel and the tiered groove.

4. A weapon according to claim 3, wherein the adapter part further includes an axial section having an inside surface with a curvature corresponding to the inside diameter of the interchangeable barrel.

5. A weapon comprising the barrel holder of claim 1.

* * * * *